US008882108B2

(12) United States Patent
Kawamata et al.

(10) Patent No.: US 8,882,108 B2
(45) Date of Patent: Nov. 11, 2014

(54) INK-JET PRINTER

(71) Applicants: Noriyuki Kawamata, Nagoya (JP); Yuji Koga, Nagoya (JP); Wataru Sugiyama, Aichi-ken (JP); Kenji Samoto, Nagoya (JP)

(72) Inventors: Noriyuki Kawamata, Nagoya (JP); Yuji Koga, Nagoya (JP); Wataru Sugiyama, Aichi-ken (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/060,428

(22) Filed: Oct. 22, 2013

(65) Prior Publication Data

US 2014/0043420 A1 Feb. 13, 2014

Related U.S. Application Data

(63) Continuation of application No. 13/033,546, filed on Feb. 23, 2011, now Pat. No. 8,590,892.

(30) Foreign Application Priority Data

Jun. 17, 2010 (JP) ..... 2010-137919

(51) Int. Cl.
*B65H 5/06* (2006.01)
*B41J 13/02* (2006.01)
*B41J 13/03* (2006.01)

(52) U.S. Cl.
CPC ..... *B41J 13/03* (2013.01); *B65H 5/062* (2013.01); *B65H 2402/5152* (2013.01); *B41J 13/025* (2013.01); *B65H 2404/174* (2013.01); *B65H 2402/31* (2013.01)
USPC ..... 271/274

(58) Field of Classification Search
USPC ..... 271/272–274
See application file for complete search history.

(56) References Cited

U.S. PATENT DOCUMENTS

| | | | | |
|---|---|---|---|---|
| 5,540,427 | A | 7/1996 | Nitta et al. | |
| 6,073,927 | A | 6/2000 | Sako et al. | |
| 7,517,077 | B2 | 4/2009 | Ishii et al. | |
| 2007/0145678 | A1 | 6/2007 | Terada | |
| 2010/0001461 | A1 * | 1/2010 | Takeshita | 271/274 |

FOREIGN PATENT DOCUMENTS

| | | | |
|---|---|---|---|
| JP | H06-000750 | U | 1/1994 |
| JP | H06-135590 | A | 5/1994 |
| JP | H08-091635 | A | 4/1996 |
| JP | H10-101247 | A | 4/1998 |
| JP | H10-203693 | A | 8/1998 |
| JP | 2000-095393 | A | 4/2000 |
| JP | 2001-097595 | A | 4/2001 |

(Continued)

OTHER PUBLICATIONS

Machine translation of JP 8-91635.*

(Continued)

*Primary Examiner* — Michael McCullough
(74) *Attorney, Agent, or Firm* — Baker Botts L.L.P.

(57) ABSTRACT

There is provided an image recording apparatus including a transporting path, a recording section, a first and second rollers pinching the recording medium therebetween, a supporting member which rotatably supports the second roller, a holding member which is movable along a transporting direction of the recording medium, a bias applying member which applies a bias on the holding member, in an opposite direction opposite to the transporting direction and a load member which generates a load in the opposite direction, with respect to the recording medium.

11 Claims, 7 Drawing Sheets

(56) References Cited

FOREIGN PATENT DOCUMENTS

| | | | |
|---|---|---|---|
| JP | 2002-255404 | A | 9/2002 |
| JP | 2004-284822 | A | 10/2004 |
| JP | 2005-298083 | A | 10/2005 |
| JP | 2005-351391 | A | 12/2005 |
| JP | 2006-089252 | A | 4/2006 |
| JP | 2007-070098 | A | 3/2007 |
| JP | 2008-044730 | A | 2/2008 |
| JP | 2012-176625 | A | 9/2012 |

OTHER PUBLICATIONS

Japan Patent Office, Decision to Grant a Patent for Japanese Patent Application No. 2010-137919 (counterpart to co-pending U.S. Appl. No. 13/033,546), mailed Apr. 17, 2012.

Japan Patent Office, Notice of Reasons for Rejection for Japanese Patent Application No. 2012-112146 (counterpart to co-pending U.S. Appl. No. 13/033,546), mailed Jun. 11, 2013.

Japan Patent Office, Notice of Reasons for Rejection in counterpart Japanese Patent Application No. 2013-167318, mailed Apr. 15, 2014.

* cited by examiner

INK-JET PRINTER

CROSS REFERENCE TO RELATED APPLICATION

The present application is a continuation of U.S. patent application Ser. No. 13/033,546, filed on Feb. 23, 2011, which claims priority from Japanese Patent Application No. 2010-137919, filed on Jun. 17, 2010, the disclosures of which are incorporated herein by reference in their entirety.

BACKGROUND OF THE INVENTION

1. Field of the Invention

The present invention relates to an image recording apparatus which transports a recording medium along a transporting path, and records an image on the recording medium.

2. Description of the Related Art

In an image recording apparatus, in many cases, transporting of a recording medium such as a recording paper is carried out by a pair of rollers (a roller pair). The pair of rollers includes a drive roller which rotates when a driving force from a drive source is transmitted, and a driven roller which rotates with the rotation of the drive roller, and the recording medium is pinched by the rotating roller pair and is transported by the roller pair.

The rollers included in the pair of rollers are rotatably supported by a frame of the image recording apparatus, at two ends in an axial direction of the rollers (a width direction of the recording medium which is orthogonal to the transporting direction of the recording medium). In other words, a central portion in the axial direction of the roller is not supported. Therefore, the roller is susceptible to bending. When the roller bends, there is a fair that the pair of rollers is not capable of pinching the recording medium.

For solving such problem, a document transporting apparatus in which a rib for preventing bending of a shaft of a resist roller is provided at an intermediate portion of the shaft of the resist roller, has hitherto been known.

SUMMARY OF THE INVENTION

However, when the roller is rotatably supported at two ends in the axial direction, there is a possibility of not only bending of the roller but also causing a position shift in the transporting direction.

For instance, an image recording apparatus in which a pair of second rollers is provided at an upstream side in a transporting direction of a pair of first rollers is taken into consideration. In the image recording apparatus, a transporting velocity of the recording medium by the pair of second rollers is adjusted to be slower than a transporting velocity of the recording medium by the pair of first rollers so that a recording medium is transported while the recording medium is stretched between the two pairs of rollers. In this case, at a movement when a rear end of the recording medium has come off the pair of second rollers, the recording medium is released from the stretched state. Therefore, as a counteraction thereof, a force in the transporting direction is exerted to the recording medium. Accordingly, there is a possibility that the pair of first rollers causes a position shift in the transporting direction.

Moreover, as another example, a case in which a transporting path at an upstream side of the pair of first rollers in a transporting direction is formed to be curve-shaped is taken into consideration. When a recording medium having a high stiffness, such as a glossy paper, is transported through the curve-shaped transporting path, the recording medium assumes a state of being in a pressed contact with a guide surface on an outer side demarcating the curve-shaped transporting path. Moreover, at the movement at which the rear end of the recording medium has come off the curve-shaped transporting path, the pressure which is applied to the guide surface by the recording paper that is in pressed contact with the guide surface is released, and the force in the transporting direction is exerted to the recording medium. Accordingly, there is a possibility that the pair of first rollers causes a position shift in the transporting direction.

Moreover, in the abovementioned document transporting apparatus, since the rib is provided in the document transporting apparatus, the bending or bowing of the roller is prevented. However, it is not possible to prevent the position shift of the recording medium as described above.

The present invention has been made in view of the abovementioned issues, and an object of the present invention is to provide a structure in which it is possible to reduce or suppress a roller for transporting the recording medium from causing the position shift or bowing in the transporting direction of the recording medium.

According to a first aspect of the present invention, there is provided an image recording apparatus which records an image on a recording medium, including a transporting path which guides the recording medium;

a recording section which records an image on the recording medium guided through the transporting path;

a first roller which is provided in the transporting path at an upstream side of the recording section in a transporting direction of the recording medium;

a second roller which is arranged to face the first roller so that the transporting path is intervened between the first and second rollers, and which transports the recording medium by pinching the recording medium between the first roller and the second roller, and which has a roller surface which makes a contact with the recording medium and a nip surface which is a part of the roller surface and pinches the recording medium between the first roller and the nip surface, and which is arranged so that an axial direction of the second roller is orthogonal to the transporting direction;

a supporting member which rotatably supports the second roller, at two ends in the axial direction;

a holding member which is movable along a transporting direction of the recording medium with respect to the supporting member, and which makes a sliding contact with the roller surface of the second roller from a downstream side in the transporting direction, so that the nip surface of the second roller is exposed with respect to the first roller;

a bias applying member which applies a bias on the holding member, in an opposite direction opposite to the transporting direction; and a load member which is provided at the upstream side of the first roller and the second roller in the transporting direction, and which generates a load in the opposite direction, with respect to the recording medium which is pinched between the first roller and the second roller.

In a state of the recording medium pinched between the first roller and the second roller, when the load generated by the load member is ceased to be exerted due to some reason, a force in the transporting direction is exerted to the recording paper. As the force in the transporting direction is exerted to the recording paper, a force in the transporting direction is exerted also on the second roller which has pinched the recording medium. However, according to the abovementioned arrangement, the bias applying member has been applying a bias to the holding member in an opposite direction opposite to the transporting direction. In other words, the force in the opposite direction opposite to the transporting direction is exerted to the second roller. Therefore, by the load exerted by the load member being ceased to be exerted, the force in the transporting direction exerted to the second roller can be counterbalanced by the force exerted to the second roller in the opposite direction opposite to the transporting direction by the bias applying member.

In the present invention, even when the force in the transporting direction is exerted due to the load exerted by the load member being ceased to be exerted, the force is counterbalanced by the force exerted to the second roller in the opposite direction opposite to the transporting direction by the bias applying member. Accordingly, it is possible to reduce or suppress the second roller for transporting the recording medium from causing the position shift or bowing in the transporting direction of the recording medium.

DETAILED DESCRIPTION OF THE PREFERRED EMBODIMENTS

Figure 1:
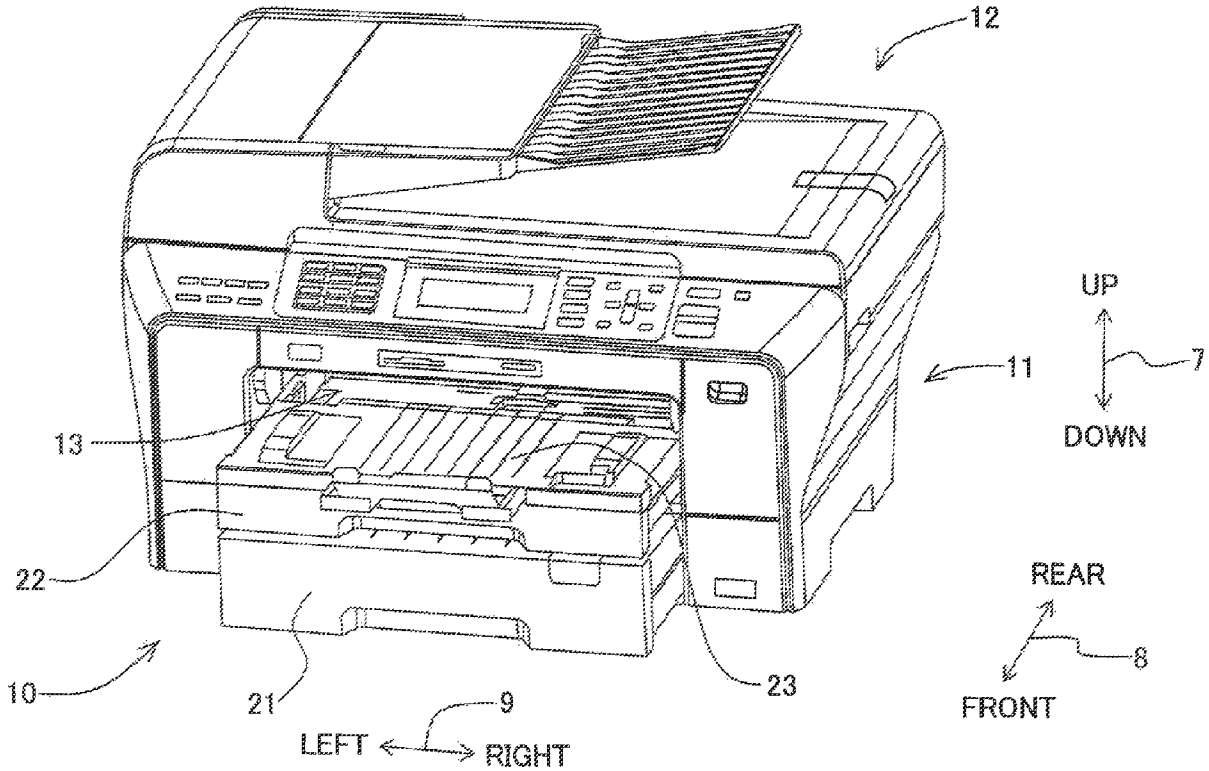
FIG. 1 is a perspective view of a multi function device 10.

An embodiment of the present teaching will be described below with reference to the accompanying diagrams. However, the embodiment described below is merely an example of the present teaching, and it is needless to mention that it is possible to make various modifications appropriately in the embodiment of the present teaching, which fairly fall within the basic teaching herein set forth. In the following description, a vertical direction 7 is defined based on a state in which a multi function device 10 is usably installed as a reference state (see FIG. 1), a front-rear direction 8 is defined upon letting a side at which an opening 13 is provided to be a frontward side (front side), and a left-right direction 9 is defined by viewing the multi function device 10 from the frontward side. Moreover, regarding paper feeding trays 21 and 22, the vertical direction 7, the front-rear direction 8, and the left-right direction 9 are defined based on a state of the paper feeding trays 21 and 22 installed on the multi function device 10 (see FIG. 1), as a reference state.

<Schematic Structure of Multi Function Device>

As shown in FIG. 1, the multi function device 10 is formed to be substantially rectangular parallelepiped shaped, and is provided with a scanner section 12 at an upper portion and a printer section 11 of an ink-jet type at a lower portion (an example of an image recording apparatus according to the present teaching). The multi function device 10 has various functions such as a facsimile function and a printing function. Functions other than the printing function are optional.

The opening 13 is formed in a front surface of a casing of the printer section 11. The printer section 11 includes the paper feeding trays 21 and 22 (an example of a tray according to the present teaching), and a recording section (an example of a recording section according to the present teaching, refer to FIG. 2). The printer section 11 is structured so that the paper feeding trays 21 and 22 are detachably installed through the opening 13 in the front-rear direction.

Figure 2:
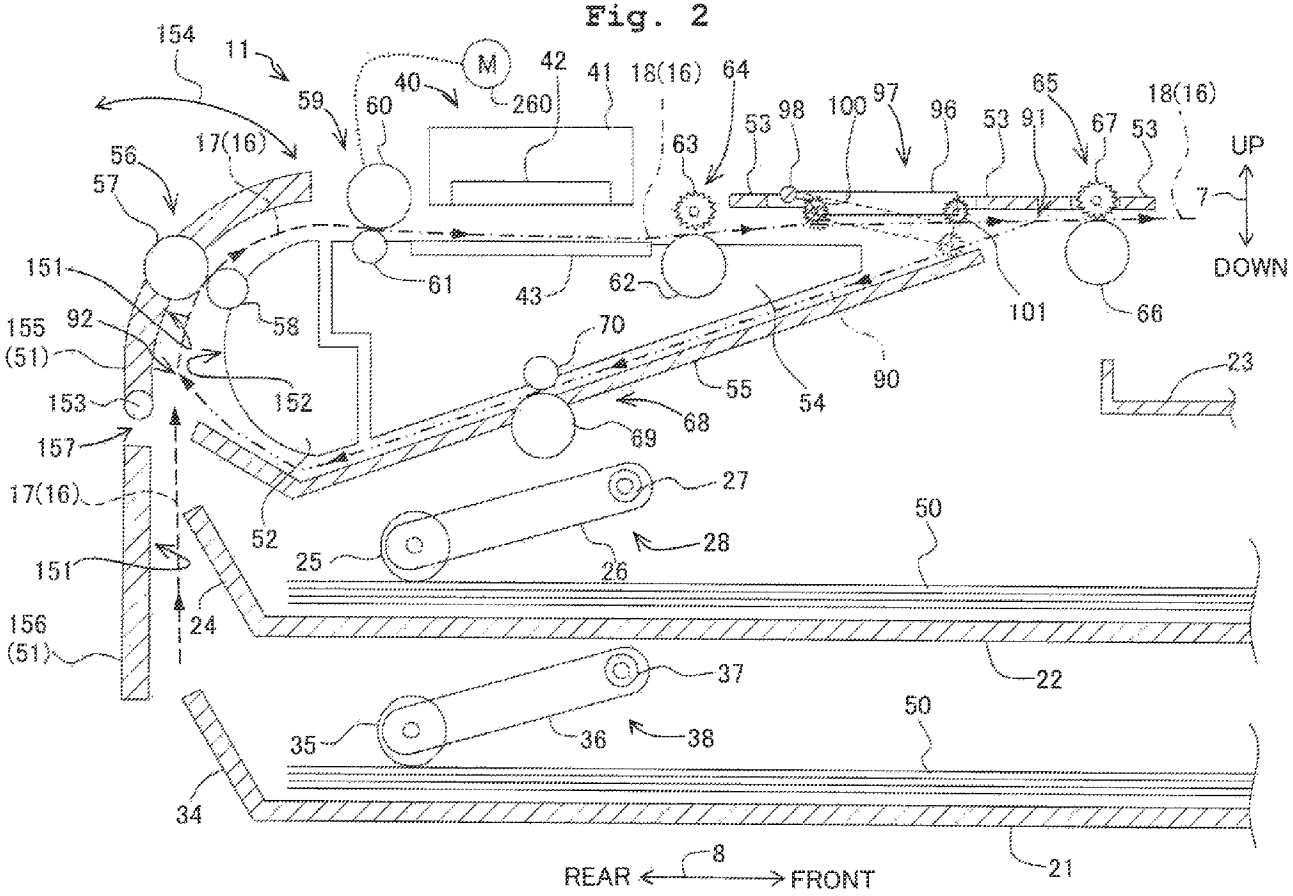
FIG. 2 is a vertical cross-sectional view showing schematically an internal structure of a printer section 11.

As shown in FIG. 2, the recording paper 50 (an example of a recording medium of the present teaching) are accommodated in the paper feeding trays 21 and 22. In the printer section 11, the recording paper 50 are supplied selectively from the paper feeding tray 21 and the paper feeding tray 22 into the printer section 11. The recording paper 50 which has been supplied is transported in a transporting direction through a first transporting path 16 that will be described later, and after an image is recorded by the recording section 40, the recording paper 50 is discharged to a paper discharge tray 23 which is provided at an upper surface of the paper feeding tray 22. Here, the transporting direction is shown by arrows on a dashed-line and arrows on an alternate long and short dashed line in FIG. 2.

As shown in FIGS. 1 and 2, the paper feeding tray 21 and the paper feeding tray 22 are arranged in two stages namely an upper stage and a lower stage, with the paper feeding tray 22 at the upper side. Since two paper feeding trays 21 and 22 are provided, it is possible to store the recording paper 50 of different sizes and/or different types in the paper feeding trays 21 and 22.

As shown in FIG. 2, the first transporting path 16 which guides the recording paper 50, and which is extended from an upper side of inclined plates 34 and 24 of the paper feeding trays 21 and 22 up to the recording section 40 via the paper discharge tray 23 is provided to the printer section 11. The first transporting path 16 includes a curved path 17 which is formed to be curve-shaped, from the upper side of the inclined plates 34 and 24 of the paper feeding trays 21 and 22 up to a pair of transporting rollers 59 which will be described later, and a discharge path 18 which is formed to be substantially straight, extending from the pair of transporting rollers 59 up to the paper discharge tray 23 via a portion right below the recording section 40. The inclined plates 34 and 24 are examples of inclined plates according to the present teaching and the first transporting path 16 is an example of a transporting path according to the present teaching. Moreover, the curved path 17 is an example of a curved path according to the present teaching. The curved path 17 and the discharge path 18 are indicated by dashed lines and alternate long and short dashed lines in FIG. 2.

The curved path 17 is demarcated or defined by an outer guide member 51 (an example of an outer guide member and a load member according to the present teaching) and an inner guide member 52 (an example of an inner guide member according to the present teaching), which are separated by a predetermined distance to be facing mutually.

The outer guide member 51 includes an outer guide surface 151 (an example of a contact surface according to the present teaching) which is facing the curved path 17, and which is in continuity along a transporting direction of the recording paper 50. Moreover, the inner guide member 52 includes an inner guide surface 152 which is facing the curved path 17. When the stiffness of the recording paper 50 which is to be transported through the first transporting path 16 is high, since the curved path 17 is bent (curved), the recording paper 50 is transported while making a contact with the outer guide surface 151.

Moreover, in the embodiment, the outer guide member 51 includes a pivoting guide member 155 which is pivotable in a direction of an arrow 154 around a shaft 153 as a center, and a fixed guide member 156 which is fixed to the printer section 11 at a lower side of the pivoting guide member 155. The pivoting guide member 155 and the fixed guide member 156 are separate members; there is a predetermined distance 157 between the pivoting guide member 155 and the fixed guide member 156. In other words, the outer guide member 51 and the outer guide surface 151 are divided. In the embodiment, the outer guide member 51 is divided at one location. However, dividing location is not restricted to one location, and the outer guide member 51 may be divided at a plurality of locations.

The discharge path 18 is demarcated by the recording section 40, a first guide member 53 which is provided at a downstream side in the transporting direction of the recording section 40, and a second guide member 54 which is arranged to face the recording section 40 and the first guide member 53, with a predetermined distance.

Each of the outer guide member 51, the inner guide member 52, the first guide member 53, the second guide member 54, and a third guide member 55 that will be described later, is extended in a direction perpendicular to a paper surface in FIG. 2.

<Supply Section>

When the paper feeding tray 22 is installed in the printer section 11, the inclined surface 24 is arranged at a lower side of the first transporting path 16, and a first supply section 28 (an example of a feeding section according to the present teaching) is arranged at an upper side of the paper feeding tray 22. The first supply section 28 includes a paper feeding roller 25, an arm 26, and a shaft 27. The paper feeding roller 25 is rotatably provided at a front-end side (opposite side of the shaft 27) of the arm 26. The arm 26 is pivotably provided to the shaft 27 which has been supported by the casing of the printer section 11. A bias is applied on the arm 26 by being pivoted toward the paper feeding tray 22 due to a weight of the arm 26 or upon being subjected to an elastic force by a spring etc. The first supply section 28 picks up the recording paper 50 from the paper feeding tray 22 and feeds to the curved path 17 via the inclined plate 24. A second supply section 38 (an example of a feeding section according to the present teaching) has a structure similar to the first feeding section 28. In other words, the second feeding section 38 includes a paper feeding roller 35, an arm 36, and a shaft 37, and picks up the recording paper 50 from the paper feeding tray 21 and feeds to the curved portion 17 via the inclined plate 34.

<Pair of Transporting Rollers>

As shown in FIG. 2, the pair of transporting rollers 59 is provided at the upstream side of the recording section 40 in the transporting direction of the recording paper 50 in the first transporting path 16. The pair of transporting rollers 59 includes a transporting roller 60 (an example of a second roller according to the present teaching) and a pinch roller 61 (an example of a first roller according to the present teaching). The transporting roller 60 is arranged at an upper side of the first transporting path 16, and rotates upon receiving a driving force from a transporting motor 260. The pinch roller 61 is arranged to face the transporting roller 60, sandwiching the first transporting path 16. In other words, the pinch roller 61 is rotatably arranged at a lower side of the first transporting path 16, and is biased by a spring, toward the transporting roller 60. Accordingly, the pair of transporting rollers 59 pinches the recording paper 50 and transports toward the recording section 40 along the first transporting path 16, or in other words, transports the recording paper 50 to a downstream side in the transporting direction.

<Pair of Discharge Rollers>

As shown in FIG. 2, a pair of discharge rollers 64 is provided in the first transporting path 16 (the discharge path 18), at the downstream side of the recording section 40 in the transporting direction. The pair of transporting rollers 64 includes a paper discharge roller 62 and a spur 63. The paper discharge roller 62 is arranged at a lower side of the discharge path 18, and rotates upon receiving a driving force from the transporting motor. The spur 63 is rotatably arranged at an upper side of the paper discharge roller 62 sandwiching the paper discharge path 18, and is biased by a spring, toward the paper discharge roller 62. Accordingly, the pair of discharge rollers 64 pinches the recording paper 50, and transports the recording paper 50 toward the paper discharge tray 23 along the paper discharge path 18, or toward the downstream side in the transporting direction.

<Pair of Intermediate Rollers>

As shown in FIG. 2, a pair of intermediate rollers 56 (an example of a load member according to the present teaching) is provided in the first transporting path 16 (curved path 17), at the upstream side of the pair of transporting rollers 59 in the transporting direction. The pair of intermediate rollers 56 includes a first intermediate roller 57 (an example of a third roller according to the present teaching) and a second intermediate roller 58 (an example of a fourth roller according to the present teaching). The first transporting roller 57 is arranged at an outer side of the curved path 17, and rotates upon receiving the driving force from the transporting motor. The second intermediate roller 58 is rotatably arranged to face the first intermediate roller 57, sandwiching the curved path 17, and is biased by a spring, toward the first intermediate roller 57. Accordingly, the pair of intermediate rollers 56 pinches the recording paper 50, and transports the recording paper 50 toward the pair of transporting rollers 59 along the curved path 17, or toward the downstream side in the transporting direction.

In the embodiment, a transporting velocity of the recording paper 50 by the pair of intermediate rollers 56 is adjusted so as to be slower (lower) than a transporting velocity of the recording paper 50 by the pair of transporting rollers 59. For instance, a gear ratio of the first intermediate roller 57 is set to be higher than a gear ratio of the transporting roller 60. Accordingly, a rotational velocity of the first intermediate roller 57 becomes slower than a rotational velocity of the transporting roller 60, and a transporting velocity of the recording paper 50 by the pair of intermediate roller 56 becomes slower than a transporting velocity of the recording paper 50 by the pair of transporting rollers 59. Moreover, as another example, a drive source of the first intermediate roller 57 and a drive source of the transporting roller 60 may be different. In this case, the drive source of the first intermediate roller 57 and the drive source of the transporting roller 60 are set so that the rotational velocity of the first intermediate roller 57 is slower than the rotational velocity of the transporting roller 60, and are controlled accordingly. By making the abovementioned arrangement, between the pair of intermediate rollers 56 and the pair of transporting rollers 59, a tension is exerted to recording paper 50 which is transported, and the recording paper 50 is in a stretched state. In other words, the pair of intermediate rollers 56 generates a load in a direction opposite to the transporting direction, on the recording paper 50 which is pinched by the pair of transporting rollers 59.

Both the first intermediate roller 57 and the second intermediate roller 58 may be configured so that none of the two rollers receive a driving force from the transporting motor. In this case, the pair of intermediate rollers 56 just pinches the recording paper 50. Therefore, when the recording paper 50 is pinched by both the pair of transporting rollers 59 and the pair of intermediate rollers 56, an area near a front end of the recording paper 50 pinched by the pair of transporting rollers 59 which rotate upon receiving the driving force is in a state of stretching an area near a rear end of the recording paper 50 which has been pinched by the pair of intermediate rollers 56. In other words, according to such arrangement also, the recording paper 50 is in a stretched state.

<Recording Section>

As shown in FIG. 2, the recording section 40 includes a carriage 41 which reciprocates in a main scanning direction (direction perpendicular to a paper surface in FIG. 2) with a recording head 42 installed thereon. Inks of various colors such as cyan (C), magenta (M), yellow (Y), and black (Bk) from respective ink cartridges are supplied to the recording head 42. The ink is jetted as fine droplets of ink from nozzles formed in a lower surface of the recording head 42. When the carriage 41 is reciprocated in the main scanning direction, the recording head 42 is scanned with respect to the recording paper 50, and an image is recorded on the recording paper 50 which is transported along the discharge path 18 on a platen 43 which has been provided under the recording section 40, facing the recording section 40. The platen 43 is a member supporting the recording paper 50 which is transported along the discharge path 18, and is supported by the second guide member 54.

The recording paper 50 which has been fed from the paper feeding tray 21 or the paper feeding tray 22 to the curved path 17 by the first supply section 28 or the second supply section 38 is guided to the recording section 40 by the pair of intermediate rollers 56 and the pair of transporting rollers 59, and an image is recorded thereon in the recording section 40. Thereafter, the recording paper 50 with an image recorded thereon is discharged to the paper discharge tray 23 by the pair of discharge rollers 64.

<Path Switching Section and Pair of Inverting Rollers>

As shown in FIG. 2, the printer section 11 is provided with a path switching section 97 and a pair of inverting rollers 65 for guiding the recording paper 50, which is positioned at a downstream side of the pair of discharge rollers 64 in the transporting direction in the discharge path 18, to a second transporting path 90 which will be described later. The path switching section 97 is provided at a downstream side of the pair of discharge rollers 64 in the transporting direction.

The pair of inverting rollers 65 is provided at a downstream side of the path switching section 97 in the transporting direction. The pair of inverting rollers 65 includes a drive roller 66 and a spur 67. The drive roller 66 rotates upon receiving a driving force from a transporting motor (not shown in the diagram). The drive roller 66 is configured so that the drive roller 66 is capable of rotating in a direction of normal rotation and a direction of reverse rotation (a CW (clockwise) direction and a CCW (counterclockwise) direction).

The path switching section 97 includes a flap 96, a shaft 98, and auxiliary rollers 100 and 101. The flap 96 is pivotably arranged between a discharge attitude (an attitude indicated by solid lines in FIG. 2) in which the recording paper 50 can be discharged to the paper discharge tray 23 along the first transporting path 16, and an inverted attitude (inverting attitude) in which the recording paper 50 can be guided to the second transporting path 90.

The path switching section 97 holds the inverted attitude in normal state, and changes from the inverted attitude to the discharge attitude by being pressed on an upper surface of the recording paper 50. Thereafter, when a rear-end portion of the recording paper 50 has reached a predetermined position which is located at an upstream side of the auxiliary roller 101, the path switching section 97 changes from the discharge attitude to the inverted attitude. Accordingly, the rear-end portion of the recording paper 50 is pushed downward by the auxiliary roller 101, and the recording paper 50 is directed toward an inverted transporting path 90.

When a double-sided recording is carried out, in a state of the rear-end portion of the recording paper 50 directed toward the inverted transporting path 90, the direction of rotation of the drive roller 66 is switched from the direction of normal rotation to the direction of reverse rotation. Accordingly, the recording paper 50 is transported to the inverted transporting path 90 by a so called switching-back method.

<Second Transporting Path>

As shown in FIG. 2, the printer section 11 of the multi function device 10 in a first modified embodiment is provided with a second transporting path 90. The second transporting path 90 is bifurcated from the discharge path 18 at a bifurcated opening 91, and is joined to the curved path 17 at a joint portion 92. The recording paper 50 is transported in a refeeding direction of refeeding through the second transporting path 90. The direction of refeeding is shown by arrows on an alternate long and two short dashes line. Front and rear surfaces of the recording paper 50 having an image recorded on a front surface thereof by the recording section 40 are inverted upon passing through the second transporting path 90, and the recording paper 50 is fed once again to the recording section 40.

The second transporting path 90 is demarcated by the abovementioned second guide member 54 and the third guide member 55 which is provided at a lower side of the second guide member 54, to face the second guide member 54 leaving a predetermined distance.

The second transporting path 90 is provided with a pair of resending rollers 68 which includes a resending roller 69 and a pinch roller 70. The pair of resending rollers 68 pinches the recording paper 50, and transports from the bifurcated opening 91 to the joint portion 92.

<Frame>

Figure 3:
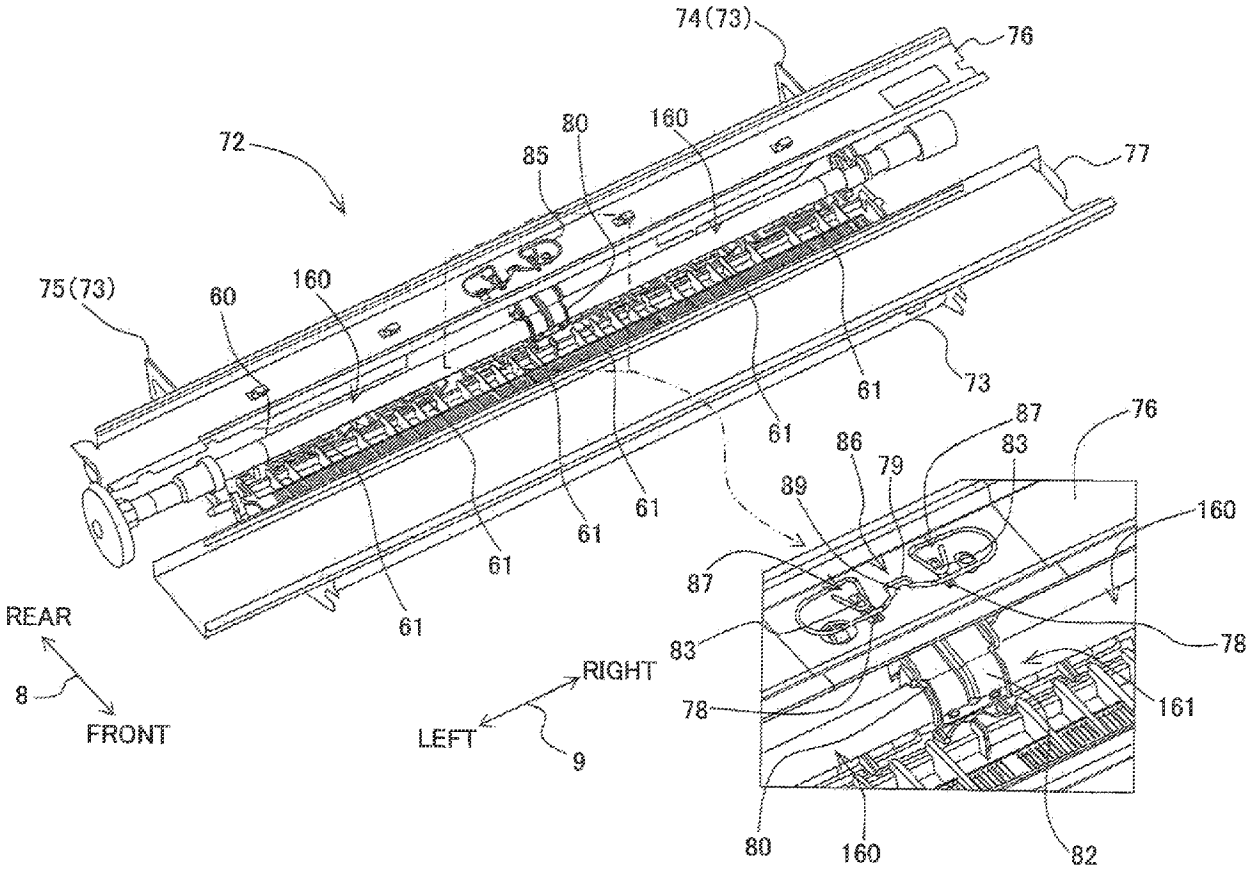
FIG. 3 is a perspective view of a frame 72, a transporting roller 60, and a holding member 80.
Figure 4:
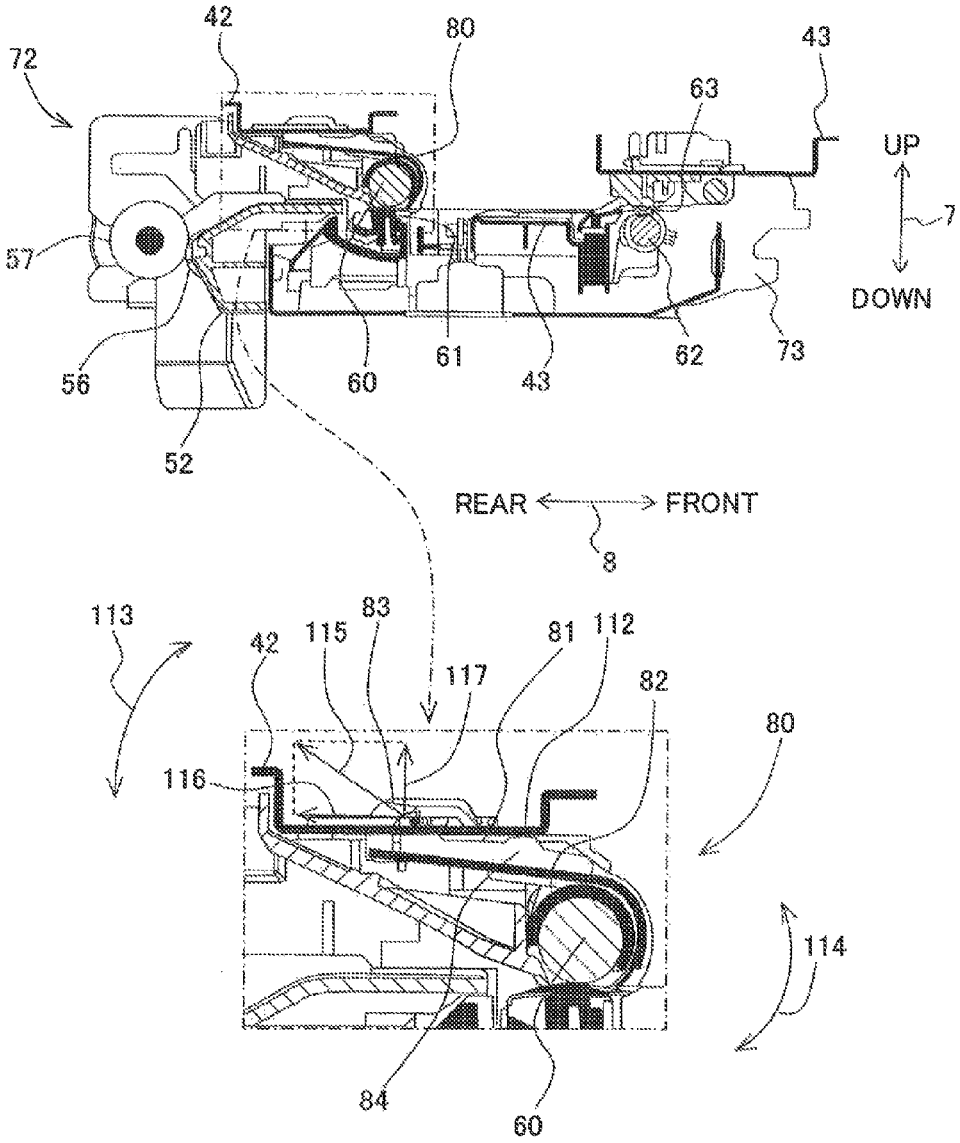
FIG. 4 is a vertical cross-sectional view of the frame 72, the transporting roller 60, and the holding member 80.

As shown in FIGS. 3 and 4, a frame 72 made of a metallic material (an example of a supporting member according to the present teaching) is provided in the casing of the printer section 11. The frame 72 is installed in the casing of the printer section 11. The frame 72 includes a frame body 73, and a pair of guide members 76 and 77 installed on the frame body 73 at an upper side of the frame body 73.

The guide members 76 and 77 are arranged at an upper side of the discharge path 18. Moreover, the guide members 76 and 77 are arranged at a predetermined distance from the recording paper 50 in the transporting direction, and are extended in a width direction (the left-right direction 9) of the discharge path 18. The abovementioned recording head 42 is held by the carriage 41, and the carriage 41 is slidingly supported by the guide members 76 and 77 in the width direction of the discharge path 18.

A pair of long holes 78 extended in the front-rear direction 8 is provided at a central portion in the left-right direction 9 of the guide member 76. An inclined portion 83 of a holding member 80 that will be described later is inserted through the long hole 78. Moreover, an opening 79 having a substantially rectangular shape is provided between the pair of long holes 78 of the guide member 76, and a protrusion (projection) 89 extended rearward from a front surface of the opening 79 is provided.

Figure 6A:
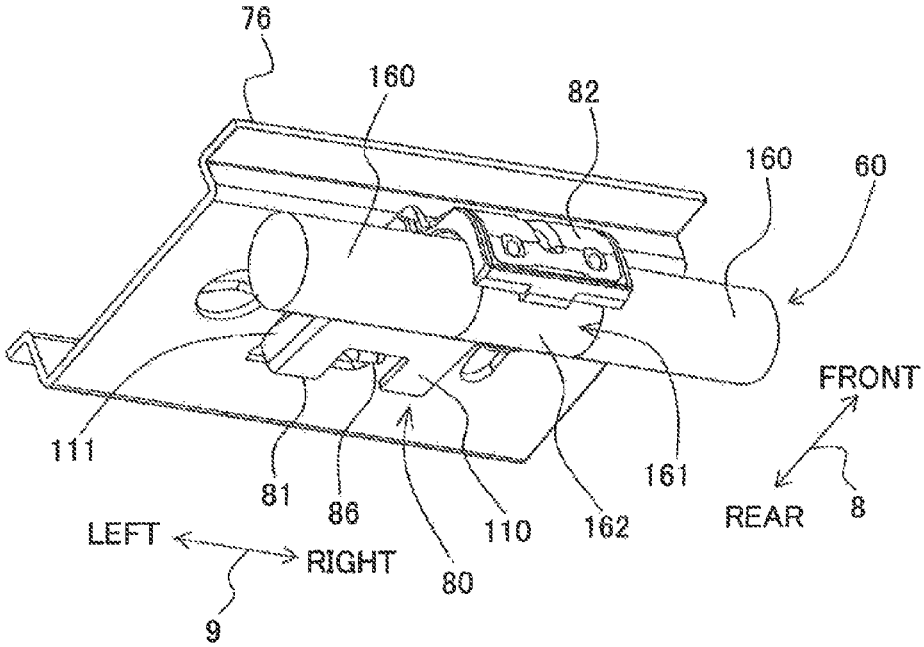
FIG. 6A and FIG. 6B are perspective views when the holding member 80 is seen from an inclined lower side at a front left, where, FIG. 6A indicates a state of the transporting roller 60 subjected to a sliding contact, and FIG. 6B indicates a state of the transporting roller 60 not subjected to the sliding contact.
Figure 6B:
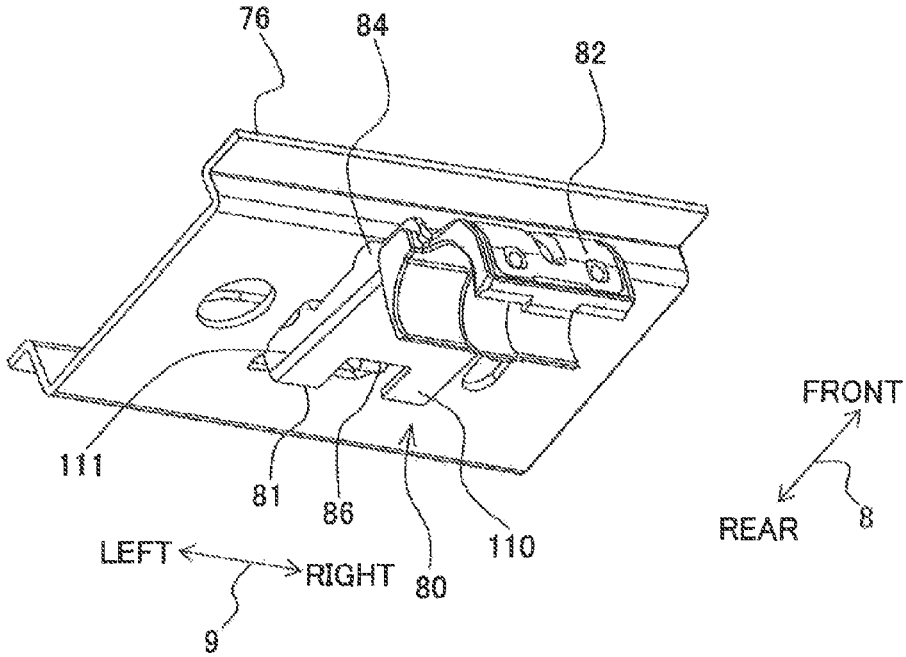
Figure 7A:
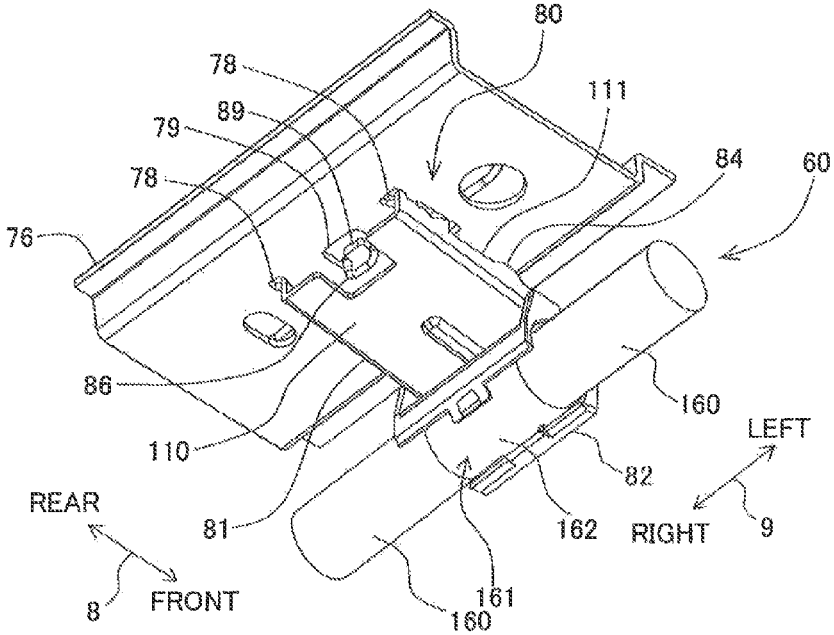
FIG. 7A and FIG. 7B are perspective views when the holding member is seen from an inclined lower side at a rear left, where, FIG. 7A indicates a state of the transporting roller 60 subjected to the sliding contact, and FIG. 7B indicates a state of the transporting roller 60 not subjected to the sliding contact.
Figure 7B:
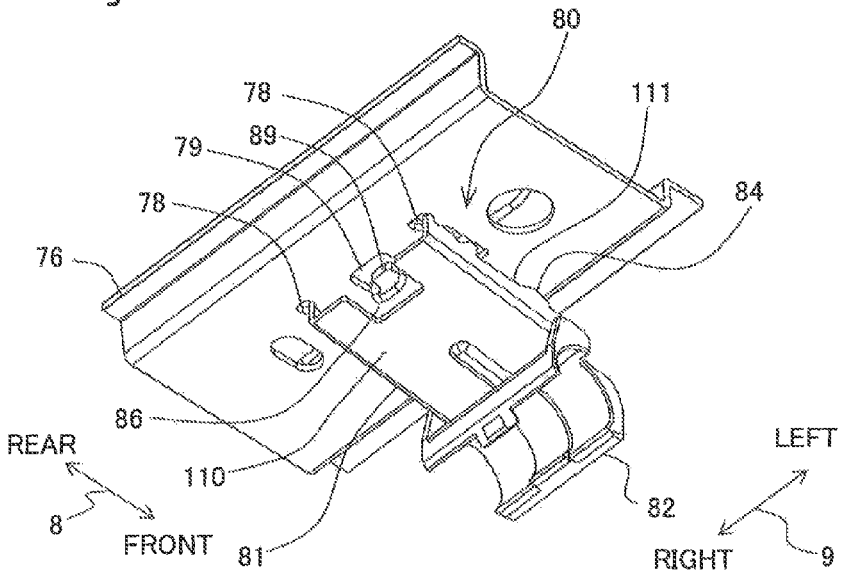

The transporting roller 60 is rotatably supported at two ends in an axial direction (left-right direction 9) by a right-side plate 74 and a left-side plate 75 of the frame body 73 which has been provided at left and right end portions of the discharge path 18. The transporting roller 60 is a circular cylindrical shaped roller formed as one roller, and is arranged so that an axial direction thereof is parallel to the left-right direction 9. The transporting roller 60 is made of steel. A roller surface 160 (corresponds to a roller surface according to the present teaching) is a front surface of the transporting roller 60, and is a surface in contact with the recording paper 50 which is transported along the first transporting path 16. An area of the roller surface 160 excluding a central portion 161 in the left-right direction 9 is subjected to ceramic processing or ceramic coating. Moreover, as shown in FIGS. 6A and 7A, a portion of the roller surface 160 which makes a sliding contact by the holding member 80 that will be described later, or in other words, the central portion 161 in the left-right direction 9 of the transporting roller 60 is not subjected to the ceramic processing, and steel material is bare. The transporting roller 60 is not necessarily required to be a roller made of steel, and the material of the transporting roller 60 may be changed appropriately according to the requirement. For instance, the transporting roller 60 may also be formed of other metallic material.

<Holding Member>

As shown in FIGS. 3 and 4, the holding member 80 (an example of a holding member according to the present teaching) is arranged at a lower side of the guide member 76. As shown in FIGS. 5 to 7B, the holding member 80 includes a body portion 81 (an example of a body portion according to the present teaching), a contact portion 82 (an example of a contact portion according to the present teaching), an inclined portion 83 (an example of an inclined portion according to the present teaching), and a supporting portion 84 (an example of a supporting portion according to the present teaching).

The body portion 81 is a member in the form of a plate having a substantially rectangular shape, and is arranged at the lower side of the guide member 76 so that a longitudinal direction of the body portion 81 is almost parallel to the front-rear direction 8. The body portion 81 includes a flat plate 110 and a side plate 111 which are protruded from two sides in the left-right direction of the flat plate 110.

The inclined portion 83 is protruded upward from an upper surface of the body portion 81. More elaborately, the inclined portion 83 is a portion near a rear end of the side plate 111 of the body portion 81, and is protruded upward from two end portions in the left-right direction. The inclined portion 83 is inserted through the long hole 78 which has been provided in the guide member 76. Accordingly, an edge (a tip) of the inclined portion 83 is in a state of being protruded from an upper surface of the guide member 76. Moreover, the holding member 80 is movable along a longitudinal direction of the long hole 78. In other words, the holding member 80 is arranged to be movable along the transporting direction of the recording paper in the discharge path 18, with respect to the frame 72.

Figure 5:
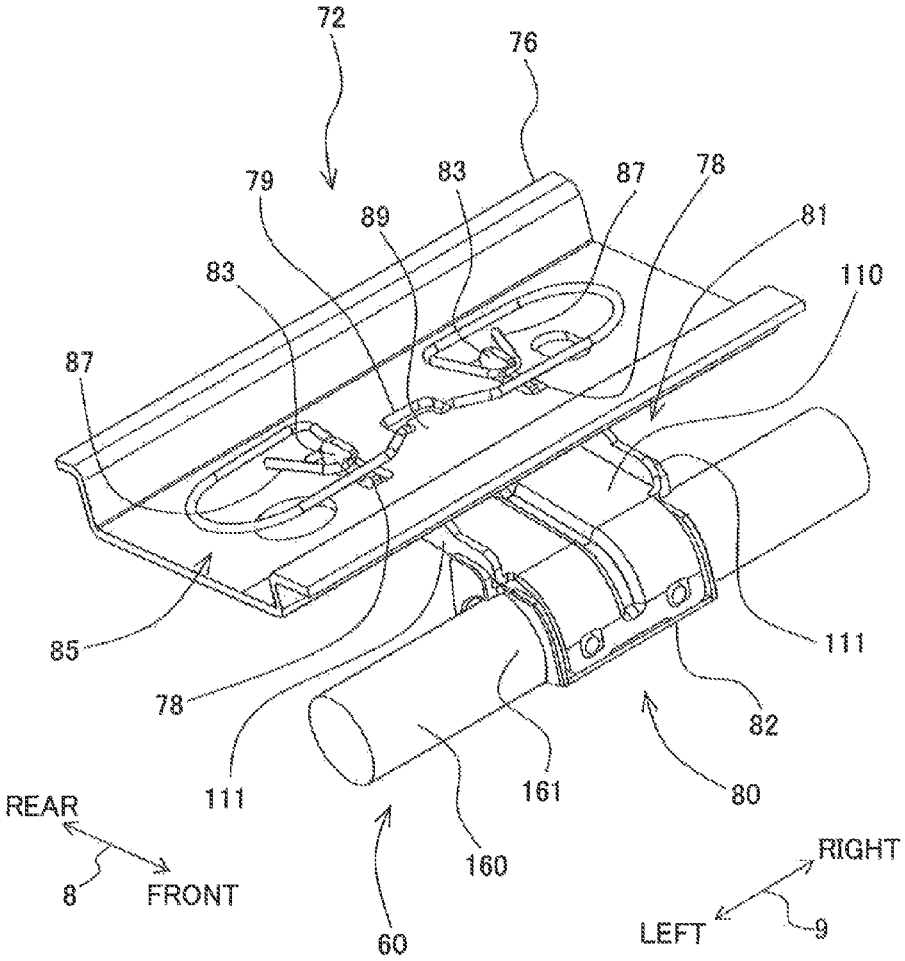
FIG. 5 is a perspective view when the holding member is seen from an inclined upper side at front left.

The inclined portion 83 is provided so that at least a front end thereof is extended in a frontward and upward inclined direction. In other words, an inclined surface is formed at the front end of the inclined portion 83. Moreover, a spring 85 (an example of a bias applying member according to the present teaching) is installed on a portion protruded (projected) from the upper surface of the guide member 76. As shown in FIG. 5, the spring 85 has a bilaterally symmetrical shape. A central portion 86 of the spring 85 (refer to FIG. 7) is hitched or hooked on a protrusion 89 provided to the guide member 76, and a bent portion 87 provided at two ends of the spring 85 is hooked on an inclined surface of the inclined portion 83 which is protruded on an upper side of the guide member 76 from the long hole 78. When the spring 85 is hooked on the inclined surface, a force 115 perpendicular to the inclined surface as shown by an arrow in FIG. 4 is exerted to the inclined surface. In other words, the force 115 perpendicular to the inclined surface has a component of a force 116 directed rearward and a component of a force 117 directed upward. Such force 116 directed rearward and the force 117 directed upward are exerted to the inclined surface. In other words, when the spring 85 is dabbed at or pressed from a lower side of the inclined surface 83, the holding member 80 including the inclined portion 83 is biased in the rearward direction and the upward direction.

As shown in FIGS. 5 to 7B, the contact portion 82 is protruded downward from a lower surface of the body portion 81, or more elaborately, from an area near a front end of the flat plate 110 of the body portion 81. In other words, the contact portion 82 is provided to be extended downward, at a downstream side of the inclined portion 83 in the transporting direction of the recording paper 50.

The contact portion 82 is provided to be extended in the left-right direction 9, and a vertical cross-section of the contact portion 82 has a shape of a circular arc of which only an area near a lower end is open. An inner diameter of the circular arc is substantially same as a diameter of the transporting roller 60. More elaborately, the inner diameter of the circular arc is substantially same as a diameter of the central portion 161 in the left-right direction 9 with a bare steel material, of the transporting roller 60. Accordingly, an inner surface of the circular arc of the contact portion 82 makes a sliding contact with the central portion 161 of the roller surface 160 of the transporting roller 60, from a direction other than the downward direction. In other words, the holding member 80 including the contact portion 82 makes a sliding contact with the central portion 161 of the roller surface 160 of the transporting roller 60, at least from the upper side and the downstream side in the transporting direction of the recording paper 50.

Moreover, as described above, only an area near a lower end of the contact portion 82 is open. Therefore, the contact portion 82 does not make a sliding contact with a surface 162 on a lower side of the central portion 161 of the roller surface 160 of the transporting roller 60. In other words, the contact portion 82 makes a sliding contact with the transporting roller 60 so that the surface 162 on the lower side of the central portion 161 of the roller surface 160 of the transporting roller 60 is exposed to the pinch roller 61. Here, the lower side of the transporting roller 60 is biased by the pinch roller 61, and the transporting roller 60 pinches the recording paper 50 between the pinch roller 61 and the transporting roller 60, at a surface on the lower side of the roller surface 160. In other words, the surface on the lower side of the roller surface 160 of the transporting roller 60 corresponds to a nip surface according to the present teaching.

As shown in FIG. 4, the supporting portion 84 is protruded upward from a substantial center (from somewhat front side than the central portion in the embodiment) in the front-rear direction 8 of the side plate 111 of the body portion 81. In other words, the supporting portion 84 is provided to be protruding from the upper surface of the body portion 81 at a downstream side of the inclined surface 83 in the transporting direction, and an upstream side of (than) the contact portion 82 in the transporting direction. An edge (a tip) of the supporting portion 84 is in a pressed contact with a point 112 on a lower surface of the guide member 76. In other words, the supporting portion 84 makes a contact with the frame 72 including the guide member 76 from below, and pushes the frame 72. As described above, the inclined portion 83 is biased by the spring 85, and the contact surface 82 makes a sliding contact with the transporting roller 60. Accordingly, the inclined portion 83 is pivotable in a direction of an arrow 113 with the point 112 as a center, and the contact portion 82 is pivotable in a direction of an arrow 114 with the point 112 as a center.

A case in which the pair of transporting rollers 59 transports the recording paper 50 at a higher velocity than pair of intermediate rollers 56, or a case in which none of the first intermediate roller 57 and the second intermediate roller 58 receive the driving force from the transporting motor, is taken into consideration. In such cases, when the recording paper 50 is pinched by the pair of transporting rollers 59 and the pair of intermediate rollers 56, the recording paper 50 is in a stretched state between the pair of transporting rollers 59 and the pair of intermediate rollers 56. When the recording paper 50 in such state is transported in the transporting direction, and when the rear end of the recording paper 50 comes off the pair of intermediate rollers 56, a force in the transporting direction is exerted to the recording paper 50. As the force in the transporting direction is exerted to the recording paper 50, a force in the transporting direction is exerted to the transporting roller 60 pinching the recording paper 50. However, according to the abovementioned embodiment, the spring 85 applies a bias to the holding member 80 in the opposite direction opposite to the transporting direction. Accordingly, the transporting roller 60 is pushed in the opposite direction by the holding member 80. In other words, the force in the opposite direction is exerted to the transporting roller 60. Therefore, the force in the transporting direction exerted to the transporting roller 60 due to ceasing of the load by the pair of intermediate rollers 56 is counterbalanced by the force in the opposite direction exerted to the transporting roller 60 by the spring 85. Accordingly, it is possible to reduce or suppress the second roller for transporting the recording medium from causing the position shift or bowing in the transporting direction of the recording medium.

When the area near the front end of the recording paper 50 is pinched by the pair of transporting rollers 59, the area near the rear end of the recording paper 50 is positioned in the curved path 17. In this case, sometimes, the area near the rear end of the recording paper 50 makes a pressed contact with the outer guide surface 151 of the outer guide member 51. Particularly, when a stiffness of the recording paper 50 is high, the possibility of the area near the rear end of the recording paper 50 making a pressed contact with the outer guide surface 151 is high. In such a case, as the rear end of the recording paper 50 is positioned at a location where the outer guide surface 151 is divided, at that moment, the recording paper 50 making a pressed contact with the outer guide surface 156 (151) is released. In other words, as the rear end of the recording paper 50 is positioned at the predetermined distance 157 at a boundary of the pivoting guide member 155 and the fixed guide member 156, at that moment, the recording paper 50 making a pressed contact with the outer guide surface 156 (151) is released. At this time, a force in the transporting direction is exerted to the recording paper 50 and the transporting roller 60. In other words, in this case, the outer guide member 51 corresponds to the load member according to the present teaching. However, as described above, the force in the transporting direction on the transporting roller 60 is counterbalanced by the force in the opposite direction by the spring 85. Accordingly, it is possible to reduce or suppress the transporting roller 60 for transporting the recording paper 50 from causing the position shift or bowing in the transporting direction of the recording paper 50.

Moreover, when the area near the front end of the recording paper 50 is pinched by the pair of transporting rollers 59, and when the area near the rear end of the recording paper 50 is positioned at the inclined plates 24 and 34 of the paper feeding trays 21 and 22, the area near the rear end of the recording paper 50 sometimes makes a pressed contact with the inclined plates 24 and 34. Particularly, when the stiffness of the recording paper 50 is high, such a possibility of the area near the rear end of the recording paper 50 making a pressed contact with the inclined plates 24 and 34 is high. In such case, when the rear end of the recording paper 50 comes off the inclined plates 24 and 34, and enters the curved path 17, at that moment, the recording paper 50 is released from the state of being in a pressed contact with the inclined plates 24 and 34, and a force in the transporting direction is exerted to the recording paper 50 and the transporting roller 60. In other words, in this case, the inclined plates 24 and 34 correspond to the load member according to the present teaching. However, as described above, the force in the transporting direction on the transporting roller 60 is counterbalanced by the force in the opposite direction exerted by the spring 85. Accordingly, it is possible to reduce or suppress the transporting roller 60 for transporting the recording paper 50, from causing the position shift or bowing in the transporting direction of the recording paper 50.

Similarly, when the area near the front end of the recording paper 50 is pinched by the pair of transporting rollers 59, and when the area near the rear end of the recording paper 50 is positioned at the second transporting roller 90, the area near the rear end of the recording paper 50 is sometimes in a pressed contact with the third guide member 55. Particularly, when the stiffness of the recording paper 50 is high, the possibility of the area near the rear end of the recording paper 50 making a pressed contact with the third guide member 55 is high. In such case, when the rear end of the recording paper 50 comes off the third guide member 55, and enters the curved path 17, at that movement, the recording paper 50 is released from the state of being in a pressed contact with the third guide member 55, and a force in the transporting direction is exerted to the recording paper 50 and the transporting roller 60. In other words, in this case, the third guide member 55 corresponds to the load member according to the present teaching. However, as described above, the force in the transporting direction on the transporting roller 60 is counterbalanced by the force in the opposite direction opposite to the transporting direction exerted by the spring 85. Accordingly, it is possible to reduce or suppress the transporting roller 60 for transporting the recording paper 50 from causing the position shift or bowing in the transporting direction of the recording paper 50.

Moreover, in the abovementioned embodiment, the inclined portion 83 is biased in the opposite direction opposite to the transporting direction by being dabbed at or pressed from below by the spring 85. Accordingly, a force in the opposite direction opposite to the transporting direction is exerted to the transporting roller 60. Therefore, even when a force in the transporting direction is exerted to the transporting roller 60, the force in the transporting direction is counterbalanced by the force in the opposite direction opposite to the transporting direction exerted by the spring 85. Accordingly, it is possible to reduce or suppress the transporting roller 60 for transporting the recording medium 50, from causing the position shift or bowing in the transporting direction of the recording paper 50.

Moreover, in the abovementioned embodiment, the inclined portion 83 is biased in the upward direction by being dabbed at or pressed from below by the spring 85. Accordingly, the inclined surface 83 which is pivotable in the direction of the arrow 113 is pivoted upward along the direction of the arrow 113. As the inclined portion 33 is pivoted upward, by a principle of leverage, a force in a downward direction is exerted to the contact portion 82. Accordingly, the contact portion 82 which is pivotable in the direction of the arrow 114 is pivoted downward along the direction of the arrow 114. In other words, the supporting portion 84 functions as a supporting portion, the inclined portion 83 functions as a power point, and the contact portion 82 functions as a point of action. Accordingly, since the transporting roller 60 assumes a state of being pushed downward by the contact portion 82, it is possible to reduce the position shift or bowing in the vertical direction 7 of the transporting roller 60.

<Modified embodiment>

In the abovementioned embodiment, an arrangement in which the transporting roller 60 is arranged at the upper side of the first transporting path 16, and the pinch roller 61 is arranged at the lower side of the first transporting path 16 has been described. However, the present teaching is not restricted to such an arrangement. For instance, an arrangement may be made to be such that, the transporting roller 60 is arranged at the lower side of the first transporting path 16, and the pinch roller 61 is arranged at the upper side of the first transporting path 16. In this case, the holding member 80 is formed to be vertically symmetrical with respect to the abovementioned embodiment, and makes a sliding contact with the transporting roller 60 which has been arranged at the lower side of the first transporting path 16.

What is claimed is:

1. An ink-jet printer comprising:

a supply roller configured to supply a sheet;

intermediate rollers configured to transport the sheet by nipping the sheet supplied by the supply roller;

transporting rollers configured to transport the sheet, by nipping the sheet, transported by the intermediate rollers, the transporting rollers comprising a first roller to be driven by a motor and a second roller making a contact with the first roller;

a recording head configured to jet ink droplets onto the sheet transported by the transporting rollers; and a bias applying member applying a bias to the first roller toward the second roller, wherein the bias applying member comprises a contact member making a contact with the first roller, and a biasing member applying a bias to the contacting member toward the second roller, wherein the contact member comprises a stand portion to make a contact with the first roller in a transported direction in which the sheet is transported by the transporting rollers, wherein the stand portion comprises an upstream side portion and a downstream side portion and which are to make a contact with the both sides of the first roller in the transported direction, and wherein length, in a height direction toward the second roller from the first roller, of the upstream side portion and the downstream side portion are different each other.

2. The ink jet printer according to claim 1, further comprising a supporting member comprising two supporting portions, and configured to rotatably support the first roller by the two supporting portions, wherein the bias applying member is located between the two supporting portions.

3. The ink jet printer according to claim 2, wherein both end portions of the first roller are supported by the two supporting portions, respectively.

4. The ink jet printer according to claim 1, wherein the bias applying member is configured to apply the bias to the first roller at a center region of an area at which the first roller is to make a contact with the sheet, in an axis direction of the first roller.

5. The ink jet printer according to claim 4, wherein the first roller comprises ceramic portions at which a ceramic processing is applied and which are located at both sides of the center region of the first roller.

6. The inkjet printer according claim 1, wherein length, in the height direction, of the upstream side portion is shorter than length, in the height direction, of the downstream side portion.

7. The ink jet printer according claim 1, further comprising a metal supporting member configured to support the biasing member.

8. The inkjet printer according to claim 7, wherein the recording head is configured to move along an axis direction of the first roller and the metal supporting member extends along the axis direction.

9. The ink jet printer according to claim 7, wherein the metal supporting member comprises a plate portion onto which the biasing member is arranged and a wall portion which stands at an end of the plate portion.

10. An ink-jet printer comprising:

a first roller configured to be driven by a motor;

a second roller making a contact with the first roller, and configured to transport the sheet, by nipping, with the first roller, a recording head configured to jet ink droplets onto the sheet transported by the first roller and the second roller, a contact member making the contact with the first roller in a height direction toward the second roller from the first roller and the contact member to make a contact with both sides of the first roller in a transported direction in which the sheet is transported by the first and second roller, and a bias member applying a bias to the contact member toward the second roller, wherein the contact member comprises a stand portion to make a contact with the first roller in a transported direction in which the sheet is transported by the transporting rollers, wherein the stand portion comprises an upstream side portion and a downstream side portion and which are to make a contact with the both sides of the first roller in the transported direction, and wherein length, in a height direction toward the second roller from the first roller, of the upstream side portion and the downstream side portion are different each other.

11. An ink-jet printer comprising:

a first roller configured to be driven by a motor;

a second roller making a contact with the first roller, and configured to transport the sheet, by nipping, with the first roller, a recording head configured to jet ink droplets onto the sheet transported by the first and second rollers, and a bias applying member applying a bias to the first roller toward the second roller, wherein the bias applying member comprises a contact member making a contact with the first roller, and a biasing member applying a bias to the contacting member toward the second roller, wherein the contact member comprises a stand portion to make a contact with the first roller in a transported direction in which the sheet is transported by the transporting rollers, wherein the stand portion comprises an upstream side portion and a downstream side portion and which are to make a contact with the both sides of the first roller in the transported direction, and wherein length, in a height direction toward the second roller from the first roller, of the upstream side portion and the downstream side portion are different each other.

* * * * *